US005762289A

United States Patent [19]

Suzuki

[11] Patent Number: 5,762,289

[45] Date of Patent: Jun. 9, 1998

[54] CORE FOR WINDING A WEB OF PLASTIC FILM PRIOR TO HEAT TREATMENT OF FILM

[75] Inventor: Naoaki Suzuki, Kanagawa, Japan

[73] Assignee: Fuji Photo Film Co., Ltd., Kanagawa, Japan

[21] Appl. No.: 699,849

[22] Filed: Aug. 20, 1996

[30] Foreign Application Priority Data

Aug. 21, 1995 [JP] Japan ..... 7-211625

[51] Int. Cl.[6] ..... B65H 75/10

[52] U.S. Cl. ..... 242/610.5; 242/613.1; 242/909; 242/610.4

[58] Field of Search ..... 242/613.1, 613, 242/610.4, 610.5, 610.6, 909

[56] References Cited

U.S. PATENT DOCUMENTS

| | | | |
|---|---|---|---|
| 1,121,905 | 12/1914 | Dorricott | 242/613.1 |
| 3,297,155 | 1/1967 | Gattenby, Jr. et al. | 242/613.1 |
| 3,602,449 | 8/1971 | Sroka | 242/909 |
| 3,645,820 | 2/1972 | Clary et al. | 156/191 |
| 4,021,001 | 5/1977 | Sproat | 242/610.4 |
| 4,242,297 | 12/1980 | Dacey et al. | 242/613.1 |
| 4,934,622 | 6/1990 | Hakiel . | |

FOREIGN PATENT DOCUMENTS

| | | | |
|---|---|---|---|
| 421400 | 10/1991 | European Pat. Off. . | |
| 4306169 | 2/1993 | Germany . | |
| 56-45211 | 4/1981 | Japan | 242/909 |
| 59-143836 | 8/1984 | Japan | 242/613.1 |
| 4247321 | 9/1992 | Japan . | |
| 5-49575 | 7/1993 | Japan . | |

*Primary Examiner*—John M. Jillions
*Attorney, Agent, or Firm*—Sughrue, Mion, Zinn, Macpeak & Seas, PLLC

[57] ABSTRACT

A core for winding a web of plastic film prior to heat treatment of the film is provided with annular collars having a height of 1 to 10 times the thickness of the film.

The core includes a rigid cylindrical member of GFRP, CFRP, or a composite structure of metal or heat-resistant resin material and fiber reinforced plastics, and the annular collars provided at the ends of the cylindrical member. The annular collars protect the film from a cut end mark which may be caused by the end edge of the web, degradation of flatness, and slipping with the core while the web wound around the core accepts the heat treatment.

7 Claims, 1 Drawing Sheet

CORE FOR WINDING A WEB OF PLASTIC FILM PRIOR TO HEAT TREATMENT OF FILM

BACKGROUND OF THE INVENTION

This invention relates to a core for winding a web of plastic film prior to heat treatment of a film.

Plastic films laminated with a light-selective membrane, a trasparent conductive membrane or the like, which are used in optical technical field, electrical technical field, etc., are in general heat- treated in a state of bulk roll formed by winding the plastic film around a core. The purpose of the heat treatment is in the improvement in dimensional stability upon heating, the adjustment of strength, elongation, contraction, drying, polymerization or curing of a surface layer coated on a surface of the film.

For example, Japanese Patent KOKAI 4-247321 discloses an annealing process for a magnetic recording medium having a magnetic recording layer composed of a ferromagnetic metal membrane provided on a polymer film, which comprises heat-loading, winding around a cylindrical bobbin, and then annealing, wherein another film having a thermal expansion less than the magnetic recording medium is wound around the bobbin, and then the magnetic recording medium is wound thereon. The bobbin is normal, and is a mere cylinder.

Conventional cores as above have various problems such as cut end mark which may be caused by the end edge of the film with a sharp increase of face pressure, degradation of film surface conditions or core slip occurring during loosening stress, and the like, in heat treatment for a bulk roll.

An improvement of a core form is disclosed in Japanese Patent KOKOKU 5-49575 wherein both ends of a core are enlarged by 0.5–5% of the diameter of the core to form annular collars which carry both sides of a flexible film base for photographic film in a range of 0.5–10% of total width respectively upon winding. The core was developed in order to prevent weaving upon winding the film base at high speed, but was not developed for the purpose of solving problems in heat treatment for a bulk roll.

SUMMARY OF THE INVENTION

An object of the invention is to provide a core for winding a web of plastic film prior to heat treatment of a film capable of preventing the occurrence of the cut end mark, degradation of film surface conditions, core slip, and the like.

The present invention has achieved the above object, and provides a core for winding a web of plastic film prior to heat treatment of a film, which comprises a cylindrical member and annular collars having a height of 1 to 10 times the thickness of the film at the outer periphery of both end portions of the cylindrical member, and a method for heat treatment of a film using the core.

Figure 1:
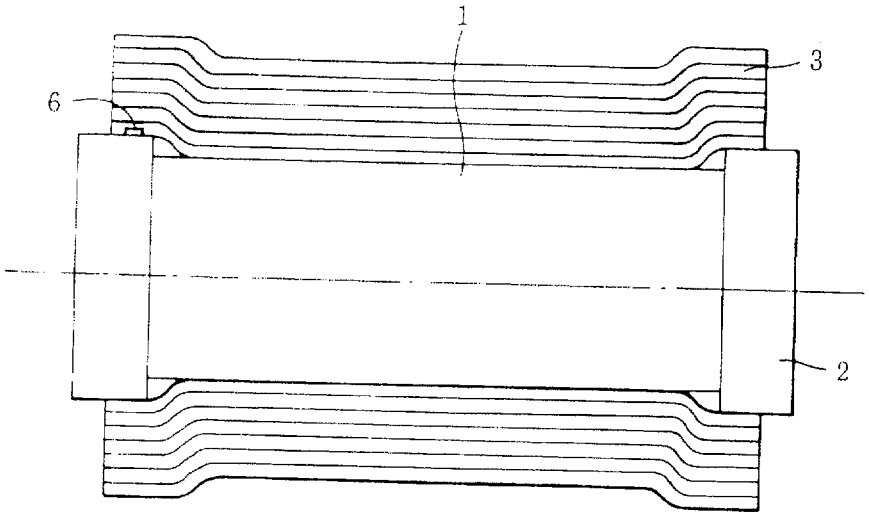
FIG. 1 is a sectional view in a plane containing the axis of a core in accordance with a first embodiment of the present invention with a film wound onto the core.

1 . . . Core
2 . . . Collar
3 . . . Film
4 . . . Taper portion
5 . . . Low heat- conductive material
6 . . . Adhesive tape

DETAILED DESCRIPTION OF THE INVENTION

The core of the invention is composed of a cylindrical member and annular collars located on the outer periphery of both end portions of cylindrical member.

The cylindrical member has a size of, in general from 500 mm to 3000 mm, particularly from 1000 mm to 2000 mm, in length, and from 100 mm to 500 mm, particularly from 200 mm to 400 mm, diameter. In relation to the width of a film to be wound, the length of the cylindrical member is in the range of 1.0 to 2.0, particularly 1.0 to 1.5 times the width of the film. The cylindrical member is made of a material resistant to heat treatment of a film, preferably having an elastic modulus at 150° C. which is 60% or more, particularly 80% or more, of the elastic modulus at 20° C. according to JIS K-7203. Examples of the materials are various metal materials, such as Al and SUS, thermosetting resin materials, such as phenol resin, heat-resistant plastic materials, such as polypropylene (PP), glass fiber reinforced plastics (GFRP) prepared by impregnating glass fiber with heat-resistant resin followed by curing, carbon fiber reinforced plastics (CFRP) prepared by impregnating carbon fiber with heat-resistant resin followed by curing, composite materials prepared by impregnating heat-resistant organic fiber with heat-resistant resin followed by curing, and so on. Preferred materials include GFRP, CFRP, and composite structure of metal or heat-resistant resin material and fiber reinforced plastics.

The annular collars are enlarged diameter portions, and in a form of convex step. The height of the collar from the surface of the cylindrical member is usually uniform over the circumference, and is about 1 to 10 times, preferably 2 to 8 times, more preferably 2 to 5 times, the thickness of a film to be wound around the core. The width of the collar is set so as to carry a side of the film in a width of 5 to 50 mm, preferably 10 to 20 mm. As the ratio of the width of the film on the collar to the total length of the cylindrical member, the ratio is 1/600 to 1/10, preferably 1/200 to 1/50. The collars are, in common, integral with the cylindrical member, although they may be separated from the cylindrical member. The material composing the collars is, in usual, the same as the cylindrical member.

By adhering an adhesive tape to the collar, the trailing end of a film to be wound can be fixed tightly. Any other fixation means can be applied, instead of or in addition to the adhesive tape.

A taper portion can be formed in connection with the step portion on the central side thereof. A suitable slope of the taper portion is, not more than 1/K, preferably in the range of 1/(2K) to 1/(100K) when K=height of step/film thickness. The material composing the taper portion is also, in usual, the same as the collars.

In the present invention, the core may further comprises a sleeve supported by the cylindrical member, and the sleeve may be formed of a low heat-conductive material having a heat conductivity lower than the material forming the cylindrical member. The sleeve keeps the circumferential face of the core flat with the collars. Suitable low heat-conductive materials are plastics, such as heat-resistant rubber sheet, heat-resistant rubber foam and urethane foam, nonwoven fabric, woven fabric, such as nylon cloth, paper, and flexible materials, such as heat-resistant rubber foam, and urethane foam and nonwoven fabric are especially preferable. Among the materials as above, a material having a heat conductivity lower than the material forming the cylindrical member and the material forming the collars is selected.

The film to be wound around the core of the invention has a size of, in general, from 500 mm to 3000 mm, particularly from 1000 mm to 2000 mm, in width, and 0.01 to 1 mm, particularly 0.05 to 0.2 mm, in thickness. Illustrative of the film materials are polyesters, such as polyethylene terephthalate (PET) and polyethylene naphthalate (PEN), polyethylene, polystyrene, polyvinyl alcohol, polyvinyl chloride, teflon, triacetyl cellulose, polyvinylidene chloride, nylon, polypropylene, polycarbonate, polyimide, polyamide-imide, polyester imide and the like, and the core of the invention is particularly effective against polyester films, such as PET and PEN. In addition, the core of the invention is also effective against papers laminated with a polymer film as mentioned above, a metal foil such as Al.

As a manner of heat treatment using the core, the web from 1000 m to 5000 m in length is wound around the core to form a roll, and the roll is heat treated at a temperature from about 60° to 140° C., e.g. 60° to 70° C. in the case of PET films, 100° to 120° C. in the case of PEN films, for 1 to 200 hours, usually 5 to 100 hours. As an embodiment of heat treatment, a process of heating the roll by blowing hot air and cooling the roll by storing it at room temperature may be practical.

By using the core of the invention provided with steps having a height of 1 to 10 times the thickness of the film web so as to catch both sides of the film by the steps, the film portion between the steps can be kept at a low in-roll pressure through heat treatment to prevent degradation of surface conditions, such as cut end marks and imprints of the core surface. Since edges of the web wound on the steps are kept at a high in-roll pressure even after heat treatment as well as fastening an adhesive tape adhered on the steps by the high in- roll pressure, core slip does not occur. By providing the steps with a taper portion, folding, wrinkling and elongation on the sides of the film can be prevented. By adopting the sleeve of a low heat-conductive material between the steps, surface conditions can further be improved. The above effects are exhibited irrespective of diameter of the core.

EXAMPLES

Example 1

A core 1 illustrated in FIG. 1 was prepared. The core 1 was made of a GFRP hollow cylinder having a total length of 1700 mm, an outside diameter of 300 mm, an inside diameter of 250 mm, a thickness of 25 mm. Convex steps were formed as the collars 2 on the outer periphery of both end portions of the cylinder. The width of the step 2 was 120 mm and the height was varied as shown in Table 1. An adhesive tape 6 having a thickness of 0.05 mm and a width of 10 mm was wound around in step 2.

A polyethylene naphthalate (PEN) resin film web 3 having a width of 1500 mm a thickness of 100 μm and a length of 2000 m was wound around each of the above cores with heating at about 115° C. The roll of the film 3 thus formed was heat-treated at about 115° C. for 24 hours.

The occurrence of cut end marks, core slip and film edge elongation was evaluated, and the results are summarized in Table 1.

TABLE 1

| Step Height | 0 mm | 0.2 mm | 0.5 mm | 0.8 mm | 1.0 mm | 1.2 mm |
|---|---|---|---|---|---|---|
| K (Step Height/Thicknes) | 0 | 2 | 5 | 8 | 10 | 12 |
| Cut End Mark | x | ○ | ○ | ○ | ○ | ○ |
| Core Slip | x | ○ | ○ | ○ | ○ | ○ |
| Edge Elongation | ○ | ○ | ○ | ○ | Δ | x |

Evaluations were carried out as follows:

Cut end mark:

The roll of each film was unwound, and the length of the film where imprint of trailing end of the film was measured.

x . . . More than 50 m

Δ . . . 10–50 m

○ . . . Less than 10 m

Core slip: The position of the trailing end of the web was marked on the core prior to winding. After heat treatment, core slip was inspected by observing with unwinding the web.

x . . . Occurred

○ . . . Not occurred

Edge elongation: The length of the web was measured at three portions, namely central portion in the width direction and both edge portions in the width direction. The difference between the measured length of edge portion and that of control portion was determined as elongation.

x . . . Elongation of more than 1%

Δ . . . Elongation of 0.5–1%

○ . . . Elongation of less than 0.5%

As can be seen from the results of Table 1, when the step height was in the range of 1 to 10 times the thickness of the film, heat-treated films having good quality were obtained, and core slip did not occur. On the other hand, in the case of the core without the step, winding tension was not sufficiently concentrated to edge portions of the film, and in-roll pressure of the wound film increased at central portion which was used as a product. As a result, cut end mark was formed over 50 m in length from the trailing end of the film. Furthermore, core slip occurred due to weak core holding power of the roll, and thereby product quality was greatly degraded. When the step height was in the range of 1 to 10 times the thickness of the film, winding tension was concentrated to the steps. As a result, cut end marks were decreased from several meters to 20 meters. Moreover, core slip did not occur. When the step height exceeded 10 times the thickness of the film, cut end mark occurred in a length of several meters, and core slip did not occur. However, elongation in film edge portions supported by the steps greatly increased to degrade product quality of the film.

Example 2

Figure 2:
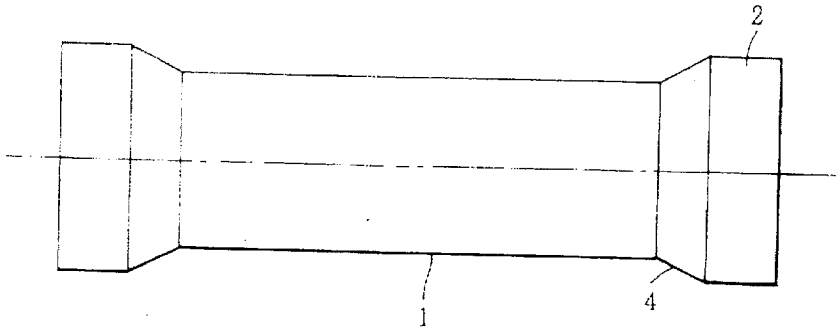
FIG. 2 is a side view of a core in accordance with another embodiment of the present invention.

A core 1 illustrated in FIG. 2 was prepared. The core 2 was the same as Example 1, except that a taper portion 4 was formed on the core center side of the steps 2. The slope of the taper portion 4 defened as step taper was varied as shown in Tables 2 and 3. The height of the steps 2 was 1 mm, in the cores of Table 2.

The same PEN resin film as Example 1 was wound around each of the above cores, and heat-treated in the same manner as Example 1.

Marks formed by folding on the edges of the heat-treated PEN resin film was observed and the results are summarized in Table 2.

TABLE 2

| Step Taper | 1/5 | 1/10 | 1/20 | 1/40 |
|---|---|---|---|---|
| Taper Factor | 2/1 | 1/1 | 1/2 | 1/4 |
| Folding Marks | Occurred | Not occurred | Not occurred | Not occurred |

K = Step height/Film thickness = 1/0.1 = 10
Taper factor = Step Taper × K

The same PEN film as employed in Example 1 except that the thickness was 0.2 mm was wound around each of the cores in Table 3. The height of the steps was 1.6 mm. Each roll was heat-treated, and the occurrence of marks formed by folding was observed. The results are summarized in Table 3.

TABLE 3

| Step Taper | 1/2.5 | 1/6.25 | 1/12.5 | 1/25 |
|---|---|---|---|---|
| Taper Factor | 3.2/1 | 1.28/1 | 1/1.56 | 1/3.125 |
| Folding Marks | Occurred | Occurred | Not occurred | Not occurred |

K = 1.6/0.2 = 8

As shown Tables 2 and 3, in the case that the taper was 1/K or less, i.e. taper factor was 1 or less, folding marks did not form at all, and products having good quality were obtained. On the other hand, in the case that the taper was greater than 1/K, film rigidity could not follow the form of taper, folding marks were formed on both edges of the film in a length of several meters around the step edges.

Example 3

Using various materials, cores 1 illustrated in FIG. 2 were prepared. The materials used were Al and two types of GFRP of which the matrix was heat-resistantepoxy resin, of which the elastic modulus at 150° C. was 60% or more of the elastic modulus at 20° C., and polyvinyl chloride resin and vinylon fiber FRP of which the matrix was polyester resin, of which the elastic modulus at 150° C. was less than 60% of the elastic modulus at 20° C.

As a result, in the latter group cores using a material having an elastic modulus at 150° C. which was less than 60% of the elastic modulus at 20° C., great diameter contraction of the core occurred upon heat treatment by the face pressure induced by winding up, starring like waves was formed on the film in the longitudinal direction in the vicinity of the core to degrade product quality of the film. On the other hand, in the former group cores using a material having an elastic modulus at 150° C. which was 60% or more of the elastic modulus at 20° C., starring caused by diameter contraction of the core did not occur at all.

Example 4

Figure 3:
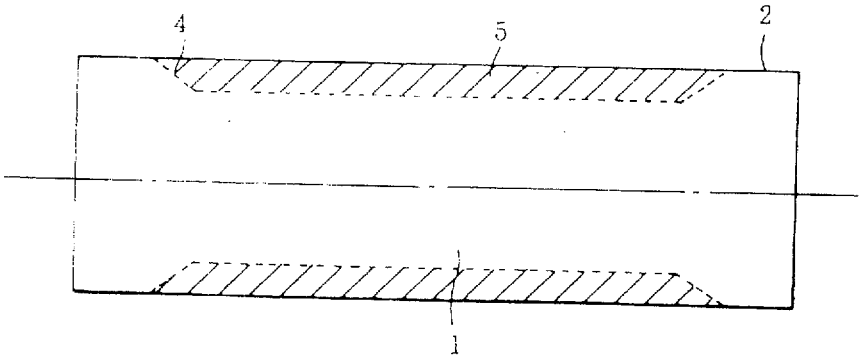
FIG. 3 is a sectional view in a plane containing the axis of a core in accordance with another embodiment of the present invention.

A core 1 illustrated in FIG. 3 was prepared using the cylindrical member in Example 2 having a step taper of 1/10 by adding the sleeve formed with heat resistant rubber foam, nonwoven fabric or heat-resistant urethane foam as the low heat-conductive material 5 or the other material between both steps 2,2, to render the circumferential face flat.

As a result, in the cores using the low heat-conductive material, rolls having very good face conditions over the whole length of the film were obtained due to no occurrence of rapid heat transfer.

It should also be understood that the foregoing relates to only a preferred embodiment of the invention, and that it is intended to cover all changes and modifications of the examples of the invention herein chosen for the purposes of the disclosure, which do not constitute departures from the spirit and scope of the invention.

I claim:

1. A core for winding a web of plastic film prior to heat treatment of the film, which comprises a cylindrical member and annular collars having a height of 1 to 10 times the thickness of the film at the outer periphery of both end portions of the cylindrical member;

wherein said collars are in forms of steps; and wherein said collars are further provided with taper portions having a slope of 1/K or less and to 1/100K or more in connection with the steps, when the slope is defined as 1/K=film thickness/step height.

2. A core as claimed in claim 1, wherein said cylindrical member and said collars are formed of a material having an elastic modulus at 150° C. of which the value is 60% or more of the value at 20° C.

3. A core as claimed in claim 1, wherein said cylindrical member and said collars are made of Al or GFRP.

4. A core as claimed in claim 1, further comprising a sleeve supported by said cylindrical member wherein said sleeve is formed of a low heat-conductive material having a heat conductivity lower than the heat conductivity of the material forming the cylindrical member.

5. A core as claimed in claim 4, wherein said sleeve is made of heat-resistant rubber foam, nonwoven fabric or heat-resistant urethane foam.

6. A core as claimed in claim 1 wherein the height of the annular collars is 2 to 8 times the thickness of the film.

7. A core as claimed in claim 1 wherein the slope is in the range of 1/(2K) to 1/(100).

* * * * *